US007111978B2

(12) United States Patent
Gerber

(10) Patent No.: US 7,111,978 B2
(45) Date of Patent: Sep. 26, 2006

(54) TIMEPIECE WITH AN INTERCHANGEABLE BEZEL

(75) Inventor: Steeve Gerber, Cressier (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 11/261,609

(22) Filed: Oct. 31, 2005

(65) Prior Publication Data

US 2006/0114753 A1 Jun. 1, 2006

(30) Foreign Application Priority Data

Nov. 26, 2004 (EP) ..... 04028072

(51) Int. Cl.
*G04B 37/00* (2006.01)
*G04B 39/00* (2006.01)

(52) U.S. Cl. ..... 368/295; 368/309

(58) Field of Classification Search ..... 368/281, 368/294–296, 300, 309
See application file for complete search history.

(56) References Cited

U.S. PATENT DOCUMENTS 4,815,053 A * 3/1989 Dal Busco ..... 368/294
5,005,161 A 4/1991 Boilen
5,319,617 A * 6/1994 Sonoda ..... 368/294
5,490,123 A 2/1996 Biver
5,541,895 A * 7/1996 Nussbaum ..... 368/295
5,822,279 A * 10/1998 Cuche et al. ..... 368/295
6,616,329 B1 * 9/2003 Sasaki et al. ..... 368/294
6,821,014 B1 * 11/2004 Hiranuma et al. ..... 368/295

FOREIGN PATENT DOCUMENTS

EP 603 353 B1 10/1997
EP 1 249 741 A1 10/2002
GB 286 107 3/1928

OTHER PUBLICATIONS

JP Utility Model Appln. No. 4134/78, dated Aug. 30, 1973 (Abstract).

* cited by examiner

*Primary Examiner*—Vit W. Miska
(74) *Attorney, Agent, or Firm*—Sughrue Mion, PLLC

(57) ABSTRACT

The bezel (1) is interchangeable via a bayonet device. The shoulder (11) of the middle part (12) is provided with a circular groove (14) and at least two sinks (15) opening out partially into said groove (14). The bezel (1) includes at least two feet (2) positioned to engage in the sinks (15), said feet (2) each including a notch (4) open radially at the emergence of the sinks (15). A locking ring (20) provided with an outer member (21) for rotational manipulation, is positioned in the groove (14), one edge (23) of said ring (20) having a substantially equal thickness to the aperture of the notches (4) and including recesses (24) for the feet (2) to pass and the other edge (25) including a gorge (26) facing a gorge (16) of the middle part (12), the two gorges (16; 26) housing a click spring (30) of the ring (20).

9 Claims, 4 Drawing Sheets

TIMEPIECE WITH AN INTERCHANGEABLE BEZEL

This application claims priority from European Patent Application No. 04028072.9 filed Nov. 26, 2004, the entire disclosure of which is incorporated herein by reference.

FIELD OF THE INVENTION

The present invention concerns a timepiece, more particularly a wristwatch comprising an interchangeable bezel, i.e. a bezel that can easily be replaced with precise positioning and without any risk of damaging the assembling means.

BACKGROUND OF THE INVENTION

A certain number of devices that allow a bezel to be replaced by another for aesthetic or functional reasons, particularly in a wristwatch, are already known. For an aesthetic purpose, this for example allows the colour of the most visible part of the watch to be match with that of clothing, at little cost. For a functional purpose, the replacement of the bezel for example allows the indications carried by said bezel to be altered, or the movement to be acted upon in order to have a multi-function watch. EP Patent No. 0 603 353 discloses a watch wherein replacement of the bezel allows the current time display to pass to a "football" or "tennis" mode, the selected bezel then comprising indications relating to such sports and means for controlling the watch mechanism in accordance with the rules of said sports.

According to the known prior art, a removable bezel is set in place and held, or conversely replaced, using devices that can be classified in two large categories, if inconvenient devices, requiring for example screwing, are excluded.

A removable bezel can be fixed by resilient means, as is disclosed in GB Patent No. 286 107. These resilient means can be formed by an elastomeric ring of suitable shape as disclosed in Japanese Utility Model No 4134/78. It may also be a snap fit device as is disclosed in U.S. Pat. No. 5,005,161. In all these resilient assemblies it is difficult to find a good compromise between a device that is sufficiently flexible to allow a user to replace the bezel without any particular effort and a device that is sufficiently secure to prevent it being accidentally lost.

In order to overcome the aforementioned drawback, a certain number of designs propose fixing the bezel to the middle part by means of a so-called "bayonet" device. The device consists in providing in the bezel and in the top part of the middle part or back cover-middle part, complementary male and female means that engage in each other when a movement of rotation is imparted to the bezel. A security system for locking/unlocking the bezel is also generally provided. A design of this type is disclosed in U.S. Pat. No. 5,490,123, the security system being formed by a push-button located on a horn of the case. In EP Patent Application No. 1 249 741, the bayonet device comprises a locking system formed of sinks arranged in the middle part and housing a spring for pushing a ball into recesses made in the inner face of the bezel. These constructions also have the drawback of being relatively complex and having a certain fragility, particularly when the bayonet device is set in place with a rotational movement of the bezel that is too forced and capable of damaging the assembling elements.

SUMMARY OF THE INVENTION

It is thus an object of the present invention to overcome the drawbacks of the prior art by allowing a bezel to be easily replaced by another bezel, via a bayonet device, with precise positioning and without any risk of damaging the assembling means.

The invention therefore concerns a timepiece, which will be illustrated hereinafter by a wristwatch with an interchangeable bezel, able to be locked by means of a bayonet device provided on the top part of the middle part of a case closed by a back cover and containing a watch movement for an analogue or digital display of time or non time-related information. The timepiece is characterized in that the shoulder of the middle part is provided with a circular groove and at least two sinks opening partially into said groove. The bezel comprises at least two feet positioned on its inner face to engage in the sinks, said feet each comprising a notch open radially above the emergence of the sinks. These notches form the "male" part of the bayonet device. The "female" part is formed by a locking/unlocking ring placed in the groove, provided with an external rotational manipulation member one edge of which has a substantially equal thickness to the aperture of the notches in the feet, and which comprises recesses for passage of the feet. The other edge of the ring includes an annular gorge facing a gorge formed in a sleeve of the middle part, the two gorges housing a click spring of the ring in the groove, while leaving said ring able to move in rotation.

Thus in order to remove a bezel, one need only rotate the ring with the manipulation member to a position where the recesses in the edge of the ring are positioned exactly above the sinks and release the passage of the bezel feet. To fit a new bezel, the reverse operation has to be carried out, then the locking ring is rotated so that the edge is engaged in the notches of the feet.

To prevent the manipulation member being accidentally moved, the bottom of the groove formed in the shoulder of the middle part is provided with a click spring which cooperates with a boss formed at the base of the locking ring.

The number of feet, and respectively sinks, is at least two. In a preferred embodiment, they are four in number while being arranged in a rectangle, to allow only two possible choices for positioning the bezel, and the feet can either be integral with the bezel or be formed by staples passing through the thickness thereof.

BRIEF DESCRIPTION OF THE DRAWINGS

Other features and advantages of the present invention will appear more clearly in the following description of an example embodiment, given by way of illustrative and non-limiting example, with reference to the annexed drawings, in which.

DETAILED DESCRIPTION OF THE INVENTION

Figure 1:
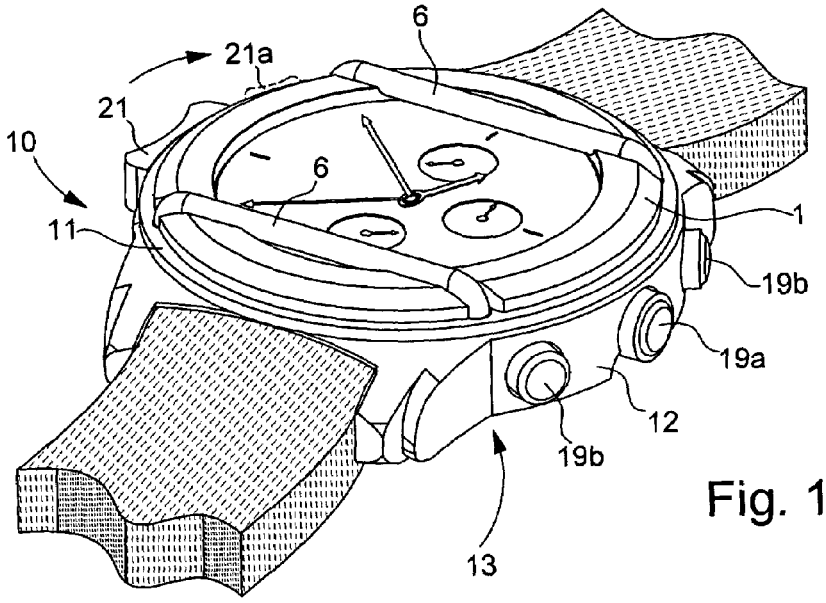
FIG. 1 shows a perspective view of a wristwatch provided with a removable bezel according to the invention.

The invention is described in more detail hereinafter taking, by way of example, a chronograph wristwatch shown in perspective in FIG. 1 and in a top view in FIG. 2, essentially in order to specify more clearly the cross-sections of the subsequent Figures.

As can be seen the watch shown comprises a case 10 formed of a middle part 12 closed by a back cover 13 and by a crystal 8 for housing a chronograph movement 7 (shown in FIG. 3) having, in a known manner, a crown 19*a* and two push-buttons 19*b*. Crystal 8 is surrounded by a bezel 1, locked via a bayonet device onto the upper shoulder 11 of the middle part 12 when the outer member 21 is positioned at 9 o'clock and able to be unlocked when a movement of rotation is imparted to said member to bring it, for example, to the 10 o'clock position, as represented in dotted lines by the reference 21*a*.

Figure 2:
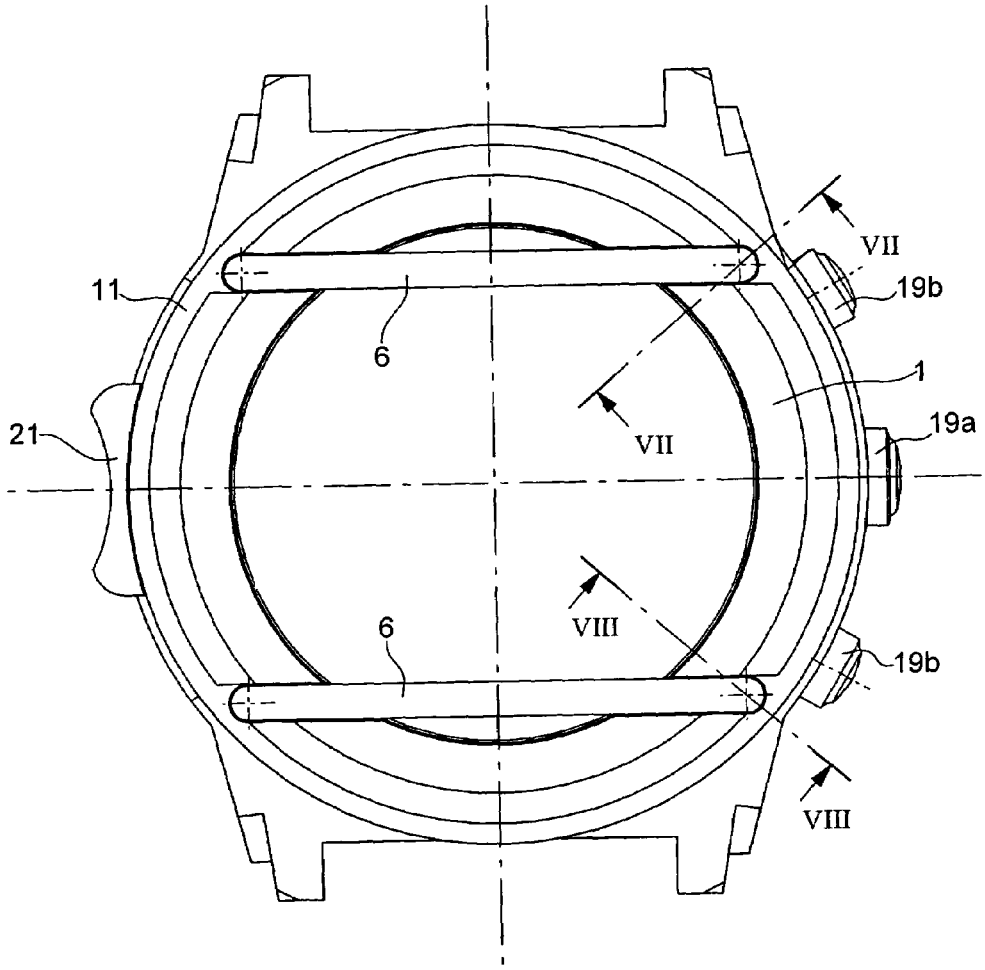
FIG. 2 is a top view of FIG. 1.
Figure 3B:
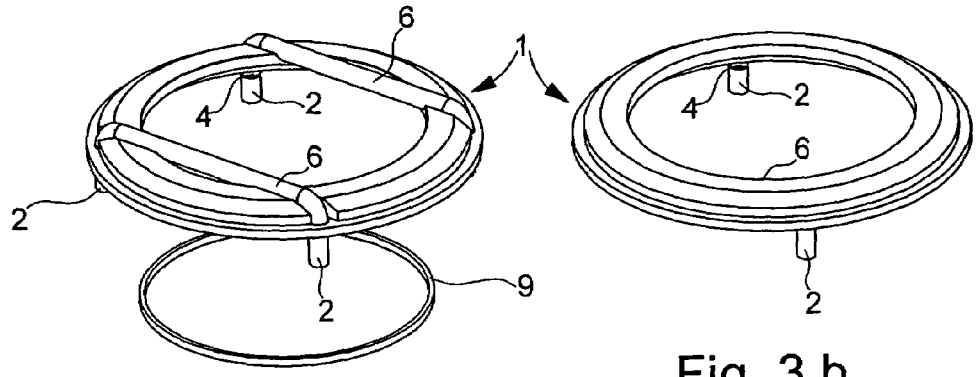
FIG. 3*b* shows a variant of the bezel.
Figure 3:
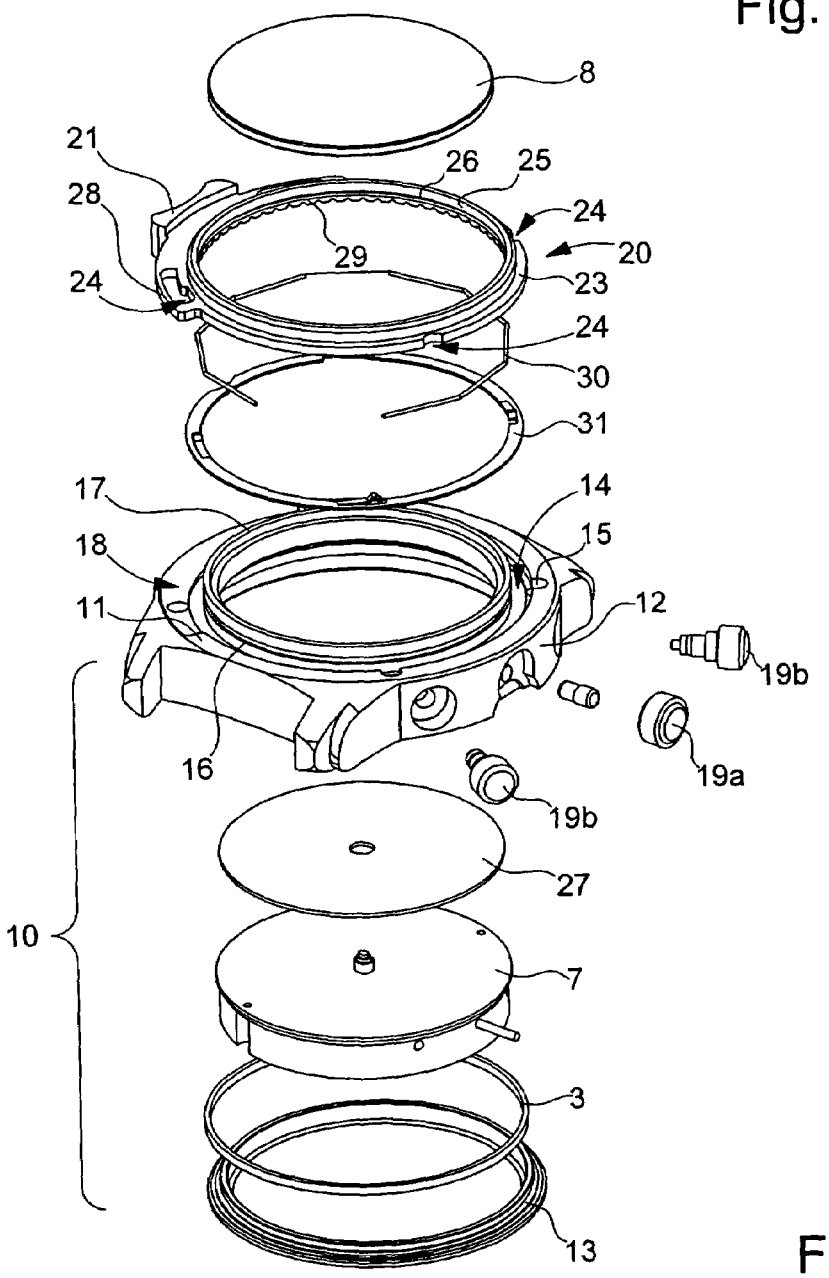
FIG. 3 is an exploded perspective diagram of the wristwatch shown in FIG. 1.
Figure 5:
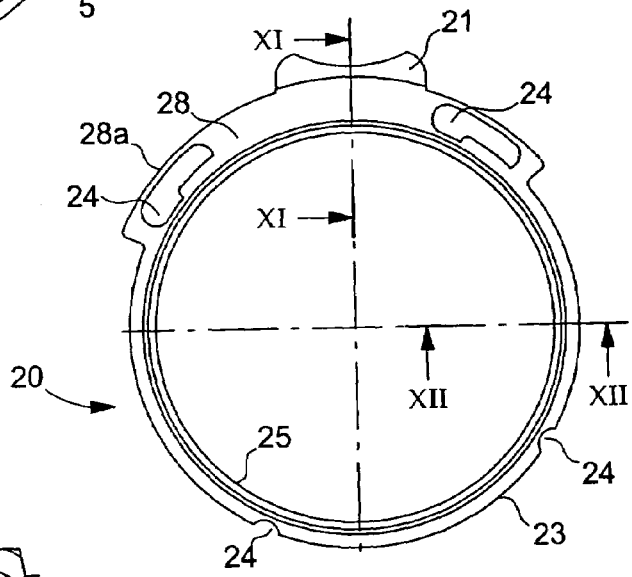
FIG. 5 is a top view of the locking ring of the removable bezel.
Figure 6:
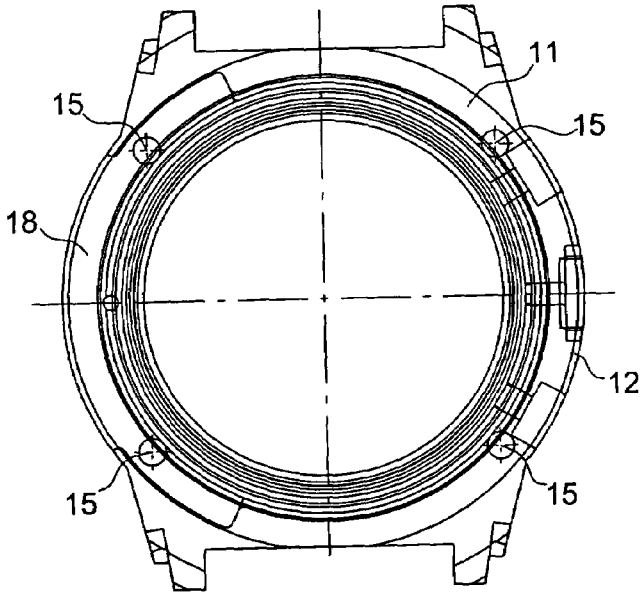
FIG. 6 is a top view of the case.

The construction of the bayonet device is explained now with reference first of all to FIG. 3, which is an exploded perspective diagram of the watch shown in FIG. 1. The bayonet device comprises a bezel 1, a case 10 and a locking ring 20, shown separately in top views in FIGS. 4, 5 and 6.

Case 10 comprises a middle part 12, in which a watch movement 7 and dial 27 are mounted, closed by a back cover 13 with the insertion of a sealing gasket. The upper shoulder 11 of middle part 12 comprises a circular groove 14, whose edge oriented towards the centre of dial 27 is extended by a sleeve 17. Shoulder 11 also comprises four vertical sinks 15 which open out partially into groove 14, i.e. having an aperture that intersects with an edge of groove 14, which is the outer edge in this example. Sleeve 17 of middle part 12 comprises an annular gorge 16 located above shoulder 11. it can also be seen that shoulder 11 has a recess 8 in an angular sector around 9 o'clock to allow manipulation member 21 to pass. Crystal 8 and sealing gasket 9 are obviously fitted onto the middle part flush with sleeve 17.

Interchangeable bezel 1, shown in FIGS. 3, 3*b*, 4 and 4*b* is provided with feet 2, the section of which allows soft engagement in sinks 15 and which are thus distributed at the base of the bezel in accordance with the same polar coordinates as sinks 15. Feet 2 have notches 4 located above shoulder 11 when feet 2 are engaged in sinks 15, said notches being cut to correspond at least to the intersection of sinks 15 and groove 14, and whose aperture corresponds to the thickness of locking ring 20, as will be explained hereinafter.

Figure 4:
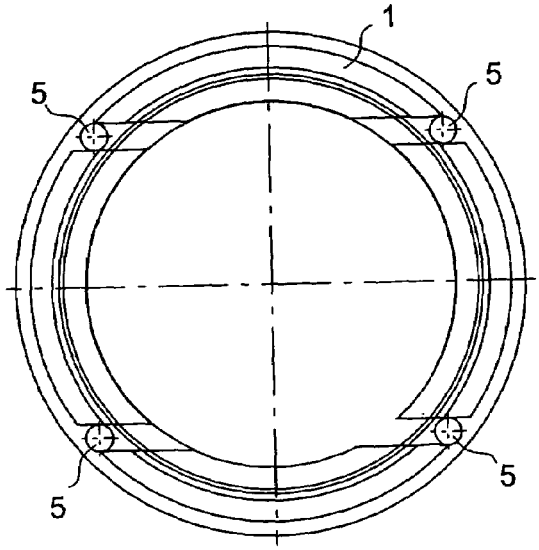
FIG. 4 is a top view of the bezel, and FIG. 4*b* an enlarged view of one foot of the bezel.
Figure 4B:
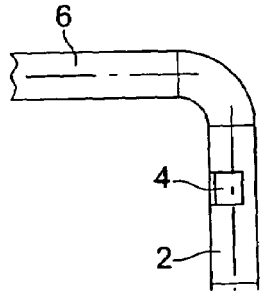

Referring more specifically to FIGS. 3, 4 and 4*b* it can be seen that four bores 5 pass through bezel 1, said bores receiving two staples 6 whose bent portions form feet 2. These staples 6 can facilitate construction of the bezel, have a decorative effect, provide protection for crystal 8 in the event of a shock and provide quasi-univalent positioning of the bezel 1 if feet 2 are arranged in the corners of a rectangle.

FIG. 3*b* shows a simplified construction in which bezel 1 only includes two feet 2 integral with the body of bezel 1, i.e. without any staples.

Referring now also to FIGS. 5, 9 to 12, the "male" part of the bayonet locking device is described hereinafter. This "male" part is formed by a ring 20 connected to manipulation member 21 by a connecting strip 28 and whose base is housed in groove 14. The outer edge 23 of ring 20 has a thickness corresponding to the opening of notches 4 arranged in feet 2 and a diameter such that it is flush with the bottom of said notches when feet 2 are set in place. In order to allow the full section of feet 2 to pass, outer edge 23 includes recess 24 whose contour corresponds to the intersection of sinks 15 and groove 14. The inner edge 25 of the ring includes a sleeve 22 abutting with friction against a sleeve 17 of the middle part. Sleeve 22 includes an annular gorge 26 facing gorge 16 of sleeve 17 of the middle part. The two gorges 16, 26 enable a spring, such as open spring 30 with a polygonal contour, to be set in place to secure locking ring 20 to case 10, while manoeuvring it around 9 o'clock position between a locked position 21 and an unlocked position 21*a*, as shown in FIG. 1. For aesthetic purposes, but also to prevent dirt from penetrating through recess 18, junction 28 is extended, on either side of manipulation member 21, by extensions 28*a* which are flush with the middle part and which encase two recesses 24.

Figure 7:
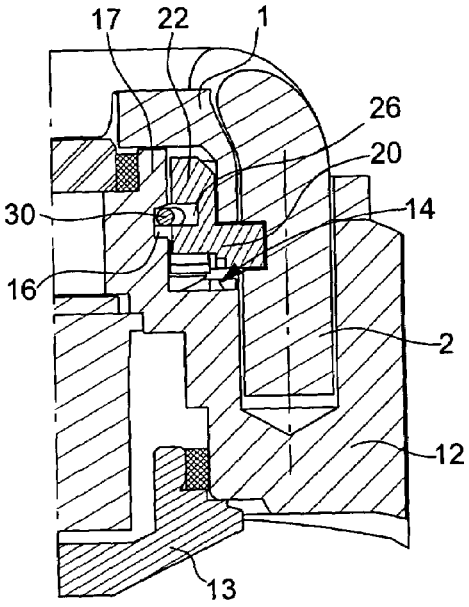
FIG. 7 is a partial cross-section along the line VII—VII of FIG. 2.
Figure 9:
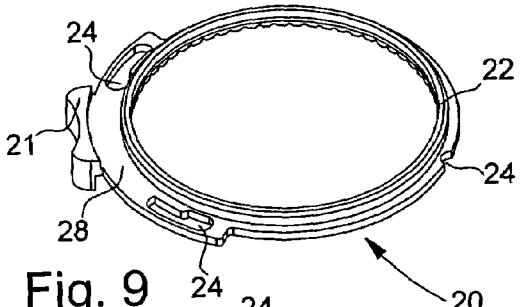
FIGS. 9 and 10 are respectively perspective top and bottom views of the locking ring.
Figure 10:
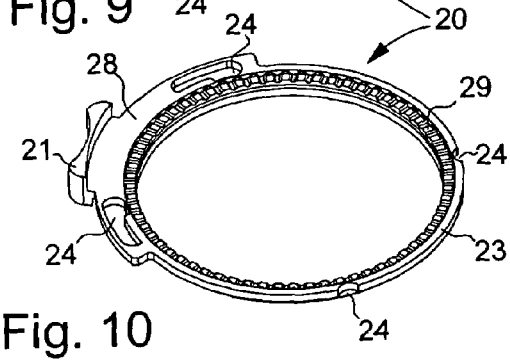
Figure 11:
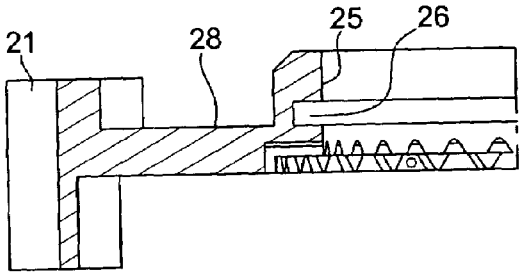
FIG. 11 is a cross-section along the line XI—XI of FIG. 5.
Figure 8:
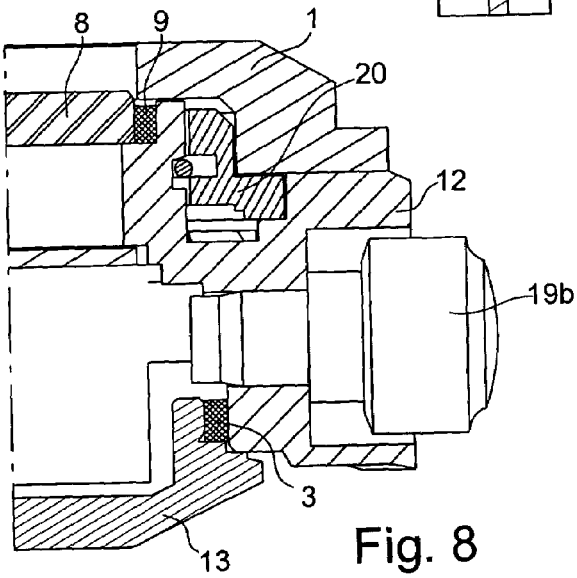
FIG. 8 is a partial cross-section along the line VIII—VIII of FIG. 2.
Figure 12:
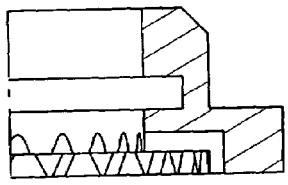
FIG. 12 is a cross-section along the line XII—XII of FIG. 5.

In order to hold the ring in one or other of the locked/unlocked positions, the wet friction assembly onto sleeve 17 of the middle part may be sufficient. It is however preferable to provide, as is visible in FIG. 10, a boss 29 at the base of the middle part for cooperating with a click spring 31 that is positioned at the bottom of groove 14, as shown in FIG. 3 and in the cross-sections of FIGS. 7 and 8. This click spring could obviously, without departing from the scope of the invention, be positioned at other places where opposite walls of middle part 12 and locking ring 20 exist.

The preceding description was made with reference to a preferred embodiment, but other alterations can be made by those skilled in the art without departing from the scope of the present invention. It is for example possible to design locking ring 20 with a "mirror image" section and to arrange manipulation member 21 on the back cover of case 10 while giving extension 28 a bent shape to pass through middle part 12 via a slot made in the bottom of groove 14, perpendicularly to the back cover.

What is claimed is:

1. A timepiece with a bezel that can be interchanged via a bayonet device provided an upper shoulder of the middle part of a case closed by a back cover to house a watch movement, wherein the shoulder is provided with a circular groove, and at least two sinks opening out partially into said groove, the bezel including at least two feet positioned to be engaged in the sinks, said feet each including a notch open radially at the emergence of the sinks, and in that a locking/unlocking ring of the bezel, provided with an outer member for rotational manipulation is positioned in the groove, one edge of said ring having a substantially equal thickness at the aperture of the notches and including recesses for the passage of the feet and the other edge including a gorge opposite a gorge of the middle part, the two gorges, housing a click spring of the ring.

2. The timepiece according to claim 1, wherein the feet are integral with the bezel.

3. The timepiece according to claim 1, wherein the bezel includes four feet formed by two staples passing through said bezel.

4. The timepiece according to claim 3, wherein the feet are arranged in a rectangle.

5. The timepiece according to claim 1, wherein the notches in the feet and the gorge in the locking ring are oriented towards the inside of the case.

6. The timepiece according to claim 1, wherein the manipulation member extends towards the exterior parallel to the back cover through a recess made in the top part of the middle part.

7. The timepiece according to claim 6, wherein the outer edge of the locking ring includes an extension extending to the edge of the middle part on either side of the manipulation member to conceal the recess between the locked position and the unlocked position.

8. The timepiece according to claim 1, wherein the manipulation member extends towards the exterior perpendicularly to the back cover through a slot made in the bottom of the groove.

9. The timepiece according to claim 1, wherein the base of the locking ring is further provided with a boss cooperating with a click spring arranged in the bottom of the groove of the shoulder of the middle part.

* * * * *